US005292996A

United States Patent [19]

Ogawa

[11] Patent Number: 5,292,996

[45] Date of Patent: Mar. 8, 1994

[54] MICROCOMPUTER WITH FUNCTION TO OUTPUT SOUND EFFECTS

[75] Inventor: Ryuichi Ogawa, Ikoma, Japan

[73] Assignee: Sharp Kabushiki Kaisha, Osaka, Japan

[21] Appl. No.: 837,209

[22] Filed: Feb. 18, 1992

[30] Foreign Application Priority Data

Aug. 7, 1991 [JP] Japan ..... 3-198078

[51] Int. Cl.[5] ..... G10H 1/02; G10H 1/46

[52] U.S. Cl. ..... 84/626; 84/633

[58] Field of Search ..... 84/601, 602, 609-614, 84/622-638, DIG. 12, DIG. 22

[56] References Cited

U.S. PATENT DOCUMENTS 4,930,390 6/1990 Kellogg et al. ..... 84/611

4,939,974 7/1990 Ishida et al. ..... 84/609

*Primary Examiner*—Stanley J. Witkowski

[57] ABSTRACT

A microcomputer with a sound effect output function, comprising a register 24 for temporarily storing a parameter specifying a sound effect to be output, a sound effect generating block 26 for outputting a signal representing a sound effect according a parameter supplied from the register 24, an output pattern setting register 25 for temporarily storing a repetition pattern of a sound effect signal supplied by the sound effect generating block 26, and an output control block 28 for outputting the sound effect signal, supplied from the sound effect generating block 26, according to the repetition pattern supplied from the output pattern setting register 25.

19 Claims, 6 Drawing Sheets

26a
BASIC CLOCK
26b
FREQUENCY DIVIDER
26c
INPUT CLOCK SELECTOR
FCK0
FCK1
LO.L1
26e
OUTPUT TIME SELECTOR
CLOCK
26d
FREQUENCY COUNTER FOR WHITE NOISE
Q
EN1
EVS
26f
UP-DOWN COUNTER FOR CONTROL OF OUTPUT TIME AND OUTPUT LEVEL
Qn
EVSW
CARRY
26g
26
24
LO.L1
FCK0
FCK1
EVSW
EVS
OUTPUT PATTERN SETTING REGISTER
25
27
SHIFT REGISTER (8 BITS)
OUT
CLOCK
LD
SEN
32
20
C P U
MEMORY
21

| | 7 | 6 | 5 | 4 | 3 | 2 | 1 | 0 |
|---|---|---|---|---|---|---|---|---|
| PREG | | STOP | L1 | L0 | FCK1 | FCK0 | EVSW | EVS |

MICROCOMPUTER WITH FUNCTION TO OUTPUT SOUND EFFECTS

BACKGROUND OF THE INVENTION

1. Field of the Invention

The present invention relates to a microcomputer including a function to output sound effects such as are used in a handy game, for example.

2. Description of the Related Art

With a conventional microcomputer including a sound output function, a series of parameter data stored in a memory of the microcomputer is read sequentially, a sound effects generating block is operated according to respective items of data which are read out, and sound effects are output.

Conventional microcomputers of this type includes a CPU (Central Processing Unit) and a memory for storing general data, connected to the CPU. The CPU is added with a circuit having a function to generate sound effects. This circuit with a sound effect generating function comprises a register for storing setting parameters for individual units of sound effects to be generated, a sound effect generating block for actually generating sounds by controlling output frequency, output time, and output level according to the parameters, a block for controlling the output of signals generated in the sound effect generating block, and so on.

To output and stop sound effects in a certain pattern, each time the output of sound effect corresponding to given parameter data ends, the next parameter data is read from the memory for data storage, this parameter data is stored in the parameter setting register, and sound effects corresponding to this parameter data are generated. Hereafter, this operation is repeated to eventually obtain a desired pattern of sound effects.

When a conventional microcomputer such as mentioned above is used, it is necessary to have all parameter data for sound effects to generate stored in the data storage memory, and therefore, a large memory area is occupied for this purpose.

SUMMARY OF THE INVENTION

Therefore, this invention has as its object to provide a microcomputer equipped with a sound-effect output function, which computer can minimize the amount of data for sound effects to be stored in the memory.

According to this invention, there is provided a microcomputer equipped with a sound-effect output function, comprising register means for temporarily storing a parameter for specifying a sound effect to generate, sound effect generating means for outputting a signal representing a sound according to a parameter supplied from the register means, output pattern setting means for temporarily storing a repetition pattern of a sound effect signal supplied from the sound effect generating means, and output control means for outputting a sound effect signal supplied from the sound effect generating means according to a repetition pattern supplied from the output pattern setting means.

The parameters read from the data storage memory and specifying the output frequency, output time, and output level of a sound effect signal to be output are temporarily stored in the register means. The sound effect generating means generates a sound effect according to a parameter supplied from the register. A repetition pattern of a sound effect read from the data storage memory of the microcomputer is temporarily stored in the output pattern setting means. The output control means synthesizes this repetition pattern and a sound effect signal output from the sound effect generating means. As a result, the sound effect signal is output in a desired repetition pattern. This contributes to a great reduction of the amount of data for generation of sound effects. Therefore, effective use can be made of the memory. In addition, a greater number of types of data for sound effects can be stored in the same memory capacity.

Further objects and advantages of the present invention will be apparent from the following description of the preferred embodiments of the invention as illustrated in the accompanying drawings.

DESCRIPTION OF THE PREFERRED EMBODIMENT

An embodiment of the present invention will be described with reference to the accompanying drawings.

Figure 1:
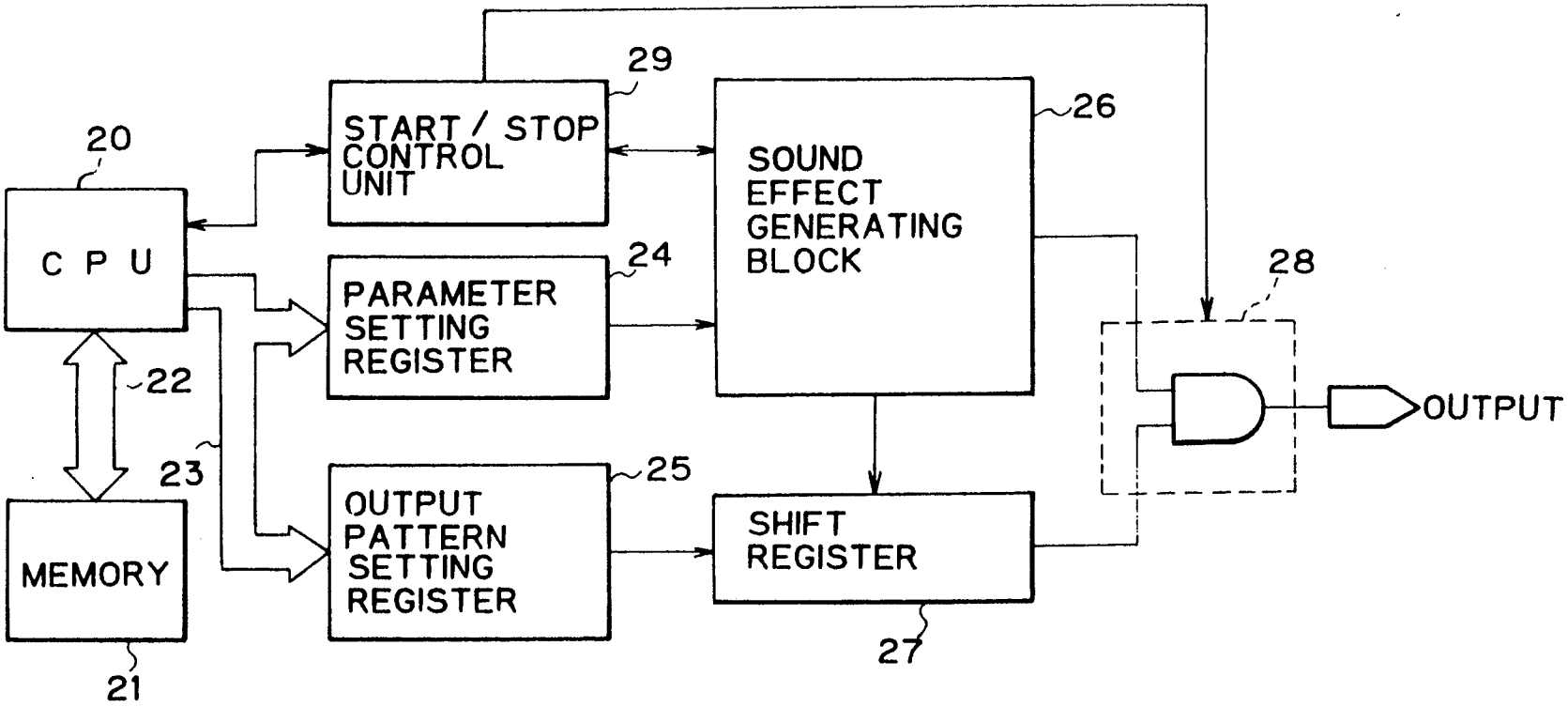
FIG. 1 shows a schematic representation of an arrangement of a preferred embodiment of the present invention.

FIG. 1 is a block diagram schematically showing an arrangement of a preferred embodiment of the present invention. This embodiment is a microcomputer having a function to generate a sound effect chiefly comprising white noise, such as a sound of explosion or the like in a shooting game, for example. The microcomputer according to this embodiment is so arranged as to selectively execute either the output control system according to the present invention or the conventional output control system.

In FIG. 1, reference numeral 20 denotes a CPU (Central Processing Unit) of a microcomputer, and 21 denotes a memory for storing general data, connected through a bus 22 to the CPU 20. Previously stored in the memory 21 are parameter data for generating sound effects, output pattern data, and a program that the CPU20 executes to transmit those data to registers. The CPU20 is connected through a bus 23 to a parameter setting register (PREG) 24 and an output pattern setting register (PREG1) 25. An output terminal of the parameter setting register 24 is connected to a sound effect generating block 26. The parameter setting register 24 is a register for setting various kinds of information for operating the sound effect generating block 26, output frequency control data, output time control data and output level control data. The output pattern setting register 25 is used to set the output pattern of the sound effect signals. The sound effect generating block 26 is a circuit which generates white noise and also outputs white noise as a sound-effect signal by controlling the output frequency, output time, and output level of the white noise according to set values of the parameter setting register 24.

The sound effect generating block 16 is connected on its output side to a shift register 27 and a output control block 28. The shift register 27 is connected on its input side to the output pattern setting register 25, and on its output side to the output control block 28. The shift register 27 receives an output pattern which has been set in the output pattern setting register 25, outputs the output pattern by shifting in step with clock pulses from the sound effect generating block 26 or the like. The output pattern is supplied to the output control block 28 as an output control signal. The output control block 28 controls the sound effect signal produced by the sound effect generating block 26 by the above-mentioned output control signal from the shift register.

CPU20 is connected with a start/stop control unit 29. The start/stop control unit 29 is connected on its output side with the sound effect generating block 26 and the output control block 28. The start/stop control unit 29 controls the start of the sound effect generating block 26 and the output control block 28, and also controls the stop of generation of sound effects and so on.

Figures 2, 2A, 2B:
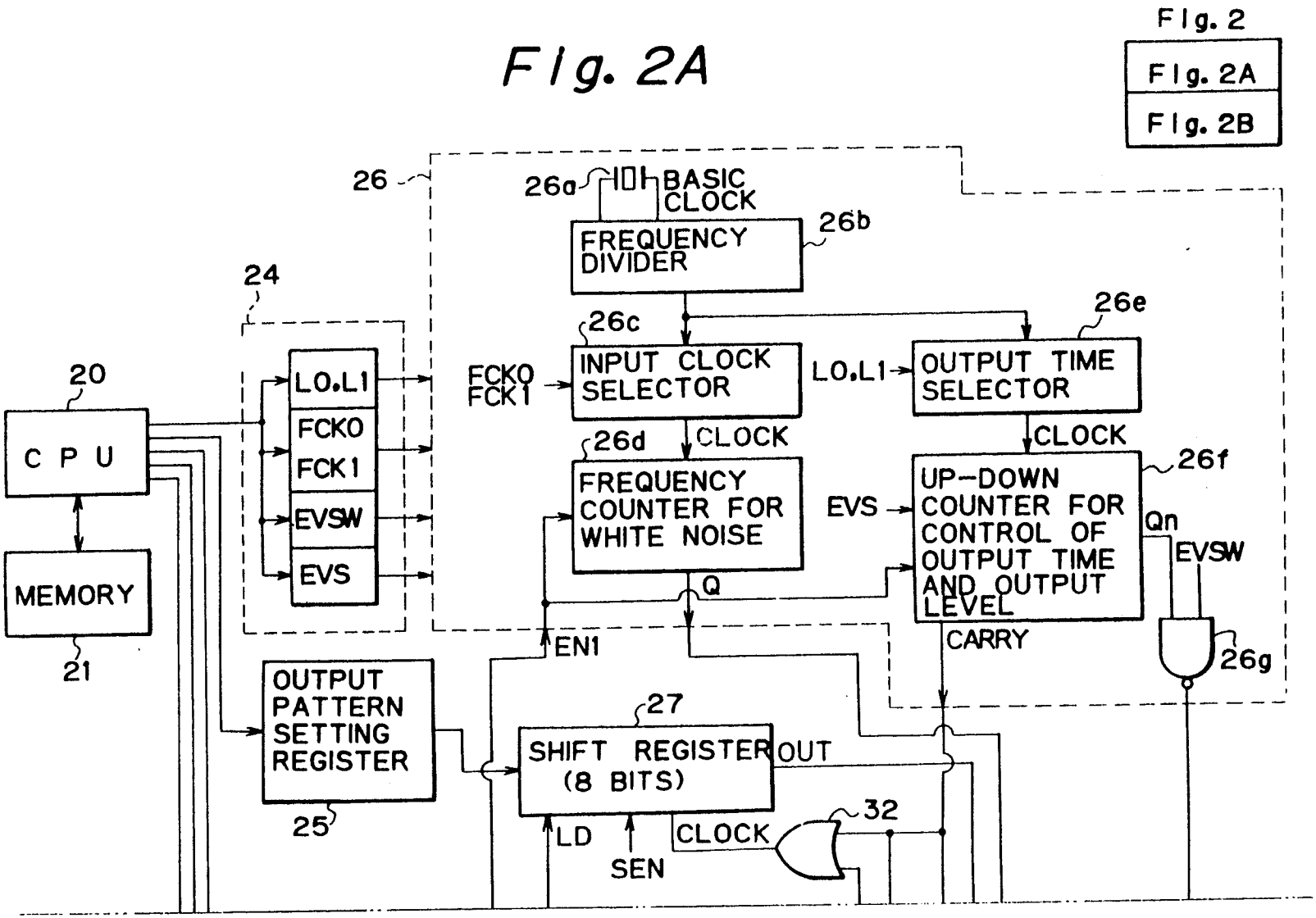
FIGS. 2, 2(*a*) and 2(*b*) show a detailed representation of the embodiment of FIG. 1.
Figure 2B:
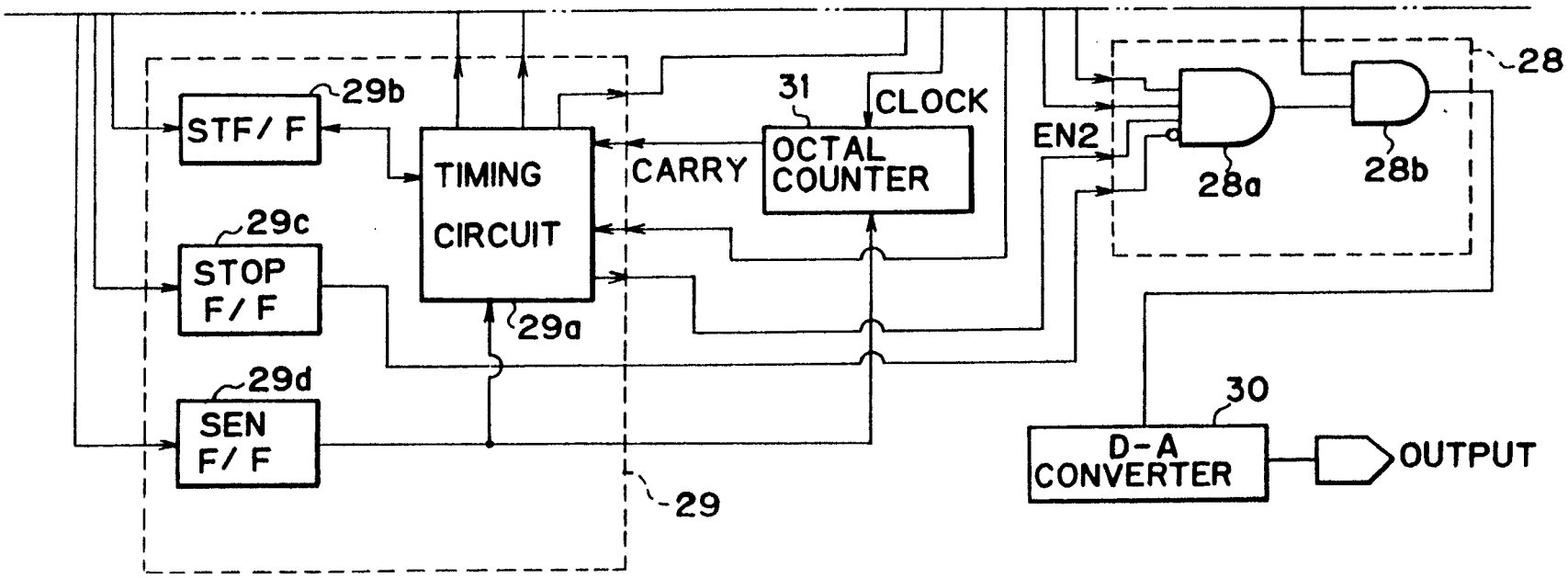

FIG. 2 combined by FIGS. 2A and 2B is a block diagram showing the embodiment in FIG. 1 in more detail.

The parameter setting register 24 is an 8-bit register in this embodiment, and this register is assigned an I/O address for one address accessible (to read/write) by CPU 20.

Figures 3, 4:
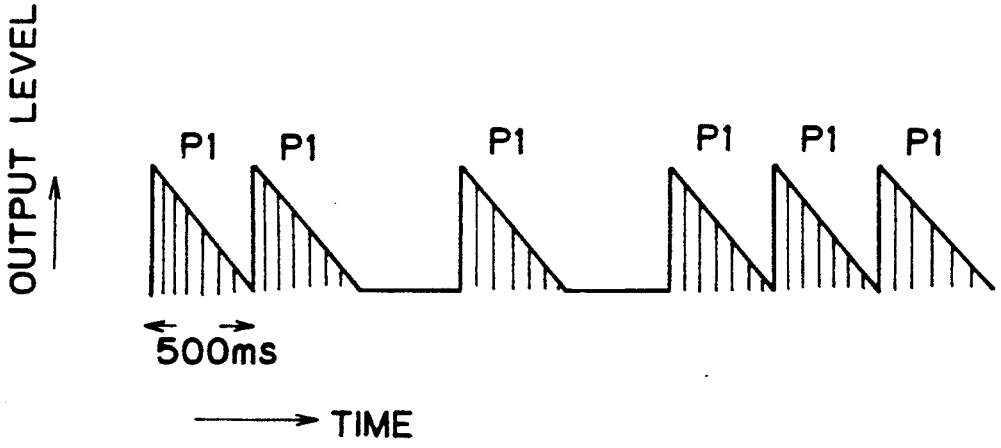
FIG. 3 is a diagram showing assignments of the bits of the parameter setting register in the embodiment of FIG. 1.
FIG. 4 is a diagram showing an output waveform of a sound effect signal in the embodiment of FIG. 1.

The respective bits of the parameter setting register 24 are assigned as shown in FIG. 3.

| | |
|---|---|
| Bit 7 | Not used |
| Bit 6 | Output stop flag STOP |
| Bits 5, 4 | Parameters L1, L2 for selecting the output time of sound effect signal |

In this case, since two bits are available, four ways of combinations are possible:

| | | |
|---|---|---|
| L1, L0 = | 0, 0 | 500 ms |
| | 0, 1 | 250 ms |
| | 1, 0 | 125 ms |
| | 1, 1 | 62.5 ms |

Bits 3, 2 . . . Parameters FCK1, FCK0 for selecting output average frequency

Four types of combinations are possible:

| | | |
|---|---|---|
| FCK1, FCK0 = | 0, 0 | 32 kHz |
| | 0, 1 | 16 kHz |
| | 1, 0 | 8 kHz |
| | 1, 1 | 4 kHz |

Bit 1 . . . Envelope (output level control) flag EVSW

EVSW=1 The output level of the sound-effect signal changes from minimum to maximum to minimum in output time set by parameters L1, L0 for output time selection.

EVSW=0 The sound effect signal is output constantly at a fixed level (maximum level).

Bit 0 . . . Envelope mode selector switch flag EVS

EVS=1 Maximum to minimum

EVS=0 Minimum to maximum

The sound effect generating block 26 is a circuit for generating sound effects chiefly including white noise, which is random noise such as "shaaa", "zheee" or the like. The sound effect generating block 26 comprises a frequency divider **26*b* for dividing the frequency of a basic clock signal from an oscillator 26*a*, a frequency counter 26*d* connected through an input clock selector 26*c* to the frequency divider 26*b*, an up-down counter 26*f* connected through an output time selector 26*e* to the frequency divider 26*b*, and a NAND gate 26*g* connected to the output terminal of the up-down counter 26*f*. Parameters FCK1 and FCK0 for selecting output average frequency supplied from the parameter setting register 24 are applied to the input clock selector 26*c*. The input clock selector 26*c* selects a frequency-divided clock signal from the frequency divider 26*b* according to the parameters, and forms an input clock signal CLOCK to the frequency counter 26*d*. The frequency counter 26*d* is a counter for generating white noise, and supplies output Q, hence a sound effect signal, the average frequency of which is controlled by the input clock signal CLOCK. The output Q is supplied to the AND gate 18*a* of the output control block 28**.

Parameters L1 and L0 for output time selection from the parameter setting register 24 are applied to the output time selector **26*e*. The output time selector 26*e* selects a frequency-divided clock signal from the frequency divider 26*b* according to the parameters, and forms an input clock signal CLOCK to the up-down counter 26*f*. The up-down counter 26*f* is a counter for controlling an output time and output level, and the counting direction is controlled according to the envelope mode (output level control) selector switch flag EVS from the parameter setting register 24**.

The output Qn of the up-down counter **26*f* is applied to one input terminal of NAND gate 26*g*. The envelope flag EVSW from the parameter setting register 24 is applied to the other input terminal of NAND gate 26*g*. One NAND gate 26*g* is shown in FIG. 2, but in actuality, NAND gates as many as the number of bits of the output Qn are provided. This output Qn is applied through the AND gate 28*b* of the output control block 28 is applied to a D-A converter 30, by which the output Qn is converted into an analog signal, so that the envelope (output level control) of the sound effect signal is performed. Overflow output CARRY of the up-down counter 26*f* is applied to the clock signal input terminal of an octal counter 31, and through OR gate 32 to the clock signal input terminal of the shift register 27. Output time of the sound effect signal is controlled by selecting a frequency-divided clock signal by the output time selector 26*e* and by detecting overflow output CARRY of the up-down counter 26*f***.

The output pattern setting register 25 is an 8-bit register in this embodiment, and this register is assigned an I/O address for one address accessible (to read/write) by CPU 20.

An output pattern, which has been stored in the start/stop control unit 29, is loaded into the 8-bit shift register 27 by a load signal LD from the timing circuit **29*a* of the start/stop control unit 29. The shift register 27 performs a shift operation in step with clock signals applied through OR gate 32. The output OUT from the shift register 27 is applied sequentially to the AND gate 28*a* of the output control block 28. As a result, the output Q of the frequency counter 26*d* is controlled by the output OUT of the shift register 27**. The AND gate 28a is operable only when it has an enable signal EN2 applied by the timing circuit 29a of the start/stop control unit 29, and a stop flag flip-flop (STOP F/F) 29c of the start/stop control unit 29 has been reset and therefore, a stop signal is not applied.

The output of the AND gate 28a is applied to the AND gate 28b and is ANDed with the output Qn of the up-down counter 26f, and then converted by the D-A converter 30 into an analog form and output.

The octal counter 31 senses the completion output of the shift register 27 by counting the overflow output CARRY of the up-down counter 26f. The overflow output CARRY of the octal counter 31 is detected by the timing circuit 29a, whereby the stop flag flip-flop 29c is set, so that the AND gate 28a is turned off.

The start/stop control unit 29 comprises start flag flip-flop (ST F/F) 29b for controlling the generation of enable signals EN1 and EN2 and an output control method selection flag flip-flop (SEN F/F) 29d besides the timing circuit 29a and the stop flag flip-flop 29c mentioned above.

When the start flag flip-flop 29b is set, the timing circuit 29a outputs an enable signal EN1, thereby making the frequency counter 26b and the up-down counter 26f of the sound effect generating block 26 operable, and outputs an enable signal EN2, thereby making the AND gate 28a of the start/stop control unit 29 operable. This start flag flip-flop 29b is reset by overflow output CARRY of the up-down counter 26f and overflow output CARRY of the octal counter 31.

When the stop flag flip-flop 29c has been set, the stop signal stays on, so that the AND gate 28a of the start/-stop control unit 29 does not operate and therefore, a sound effect signal is not supplied from the output control block 28. This stop flap is used to control the output control block 28 when a conventional output control method is used. When the output control method according to the present invention is used, the output control block 28 is controlled by the output OUT of the shift register 27.

The flip-flop 29d for output control method selection flag is either set or reset depending on whether the output control method according to the present invention or a conventional output control method is used. Only when this flip-flop 29d has already been set, the shift register 28 and the octal counter 31 are operable.

The operation in this embodiment will next be described. The following description applies to a case where the sound effect signal is generated for eight items of data as shown in FIG. 4, the sound effect signal being derived from white noise which is obtained from an input clock signal of 32 kHz and in which the output level changes from the maximum to the minimum level.

Figure 5:
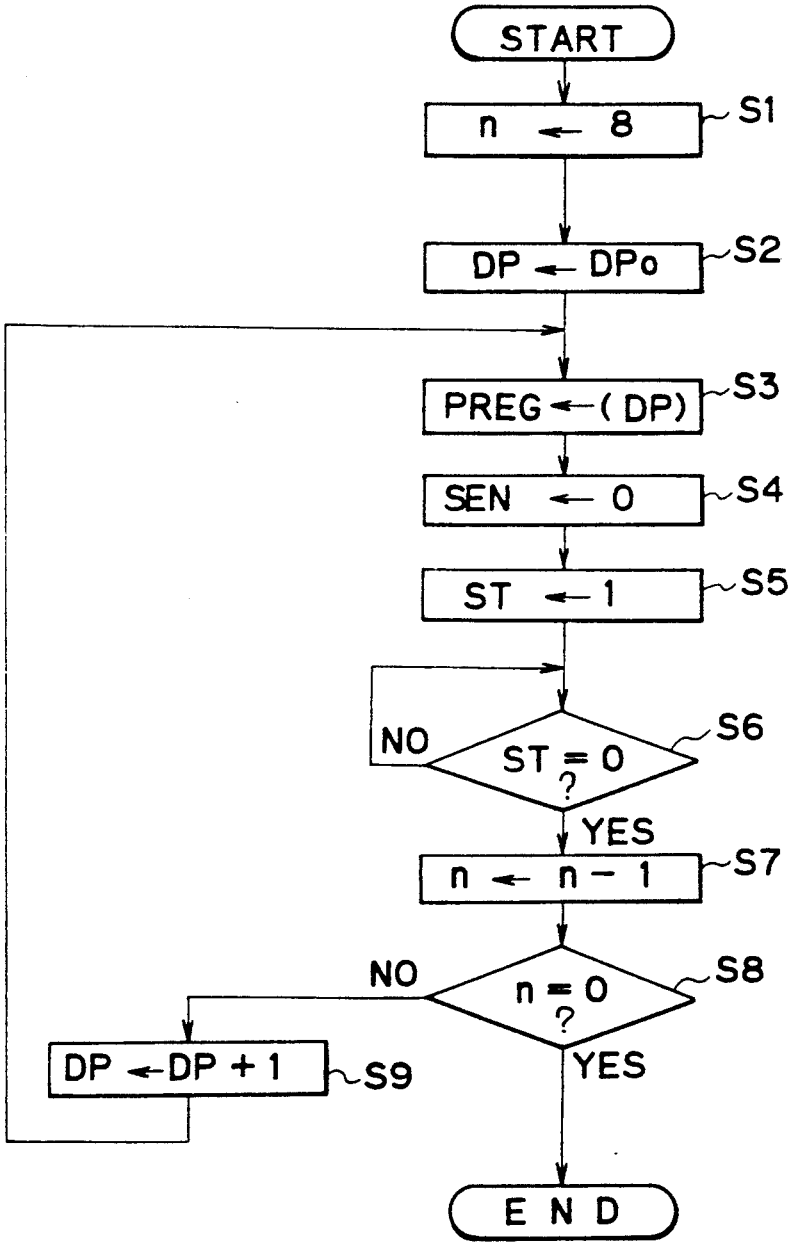
FIG. 5 shows a program when a conventional output control method in the embodiment of FIG. 1.

To begin with, a case in which a conventional control method is used will be described with reference to the flowchart in FIG. 5.

At step S1, the number n of data of sound effects (including stop data) to be output is set. In this case, n←8 is set. At the subsequent step S2, the pointer DP of the memory 21 storing data of sound effect parameters is initialized by setting DP←$DP_0$. Data of sound effect parameters is stored in the memory 21 as shown below.

| Data No. | Address | Stored parameter |
|---|---|---|
| 1 | $DP_0$ | P1 |
| 2 | $DP_0 + 1$ | P1 |

-continued

| Data No. | Address | Stored parameter |
|---|---|---|
| 3 | $DP_0 + 2$ | P2 |
| 4 | $DP_0 + 3$ | P1 |
| 5 | $DP_0 + 4$ | P2 |
| 6 | $DP_0 + 5$ | P1 |
| 7 | $DP_0 + 6$ | P1 |
| 8 | $DP_0 + 7$ | P1 |

Here, parameter P1 represents "*0000011" and parameter P2 represents "*100". The marks "*" indicates that this bit may be either "0" or "1".

At step S3, data which has been stored in the pointer DP is transferred to the parameter setting register (PREG) 24. At the next step S4, SEN←0 is set for the output control method selection flag SEN. By this, the output control method selection flag flip-flop 29d is reset, so that the shift register 27 and the octal counter 31 are made inoperable, and therefore, the conventional output control method is used.

At step S5, ST←1 is set for the start flag ST. By this, the start flag flip-flop 29b is set, and the output of a sound effect signal is started. When DP=$DP_0$, the parameter sent to and stored in the parameter setting register 24 is P1, that is to say, "*0000011". Therefore, a sound effect signal is output which has an output time of 500 ms, an output frequency of 32 kHz, and an output level change from maximum to minimum.

At step S6, a decision is made whether the start flag ST is has become ST=0 to see if the output of one data has been completed. Only when ST=0, the program proceeds to step S7 where the data number n is decremented by one.

At step S8, a decision is made whether or not n=0 to check if all data have been output. When n=0, this is considered to indicate that all data have been output and the process is finished. If not n=0, the program moves on to step S9, at which the pointer DP is incremented by one, and then steps S3 to S8 are repeated.

In consequence, the parameters P1, P1, P2, P1, P2, P1, P1 and P1 are loaded into the parameter setting register 24 one after another, and a sound effect signal is output as shown in FIG. 4. When the parameter is P2, i.e., "*100*", the output stop flag STO is "1", so that the output of a sound effect signal is stopped.

Figure 6:
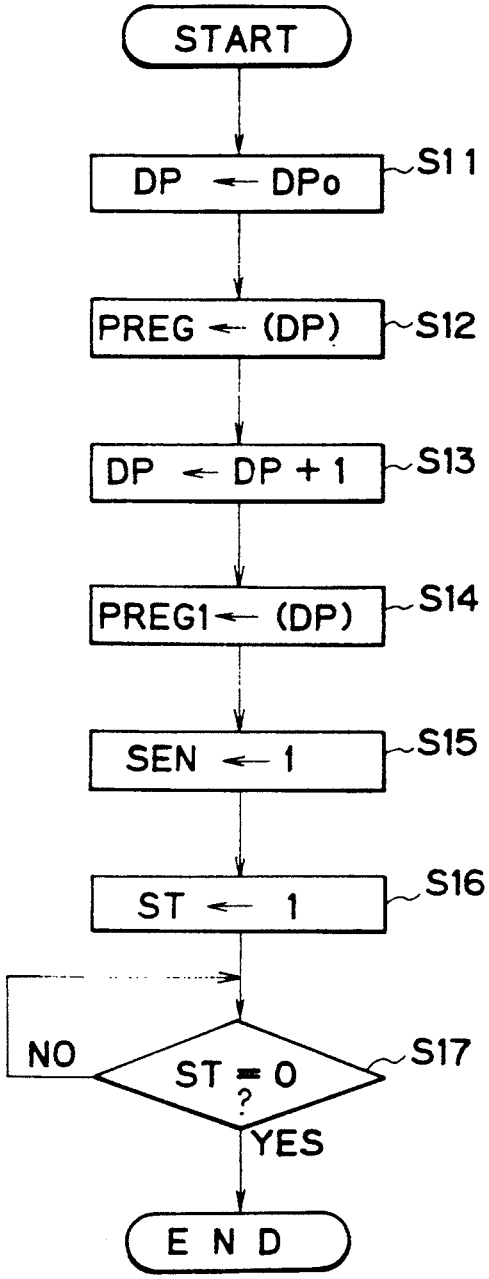
FIG. 6 shows a program when an output control method according to the present invention in the embodiment of FIG. 1.

With reference to FIG. 6, description will now be made of a case in which the output control method according to the present invention is executed.

At step S11, the pointer DP of the memory 21 storing sound effect parameter data and output pattern data is initialized by setting DP←$DP_0$. Stored in the memory 21 are the sound effect parameter data as follows.

| Data No. | Address | Stored parameter data |
|---|---|---|
| 1 | $DP_0$ | P1 |
| 2 | $DP_0 + 1$ | P3 |

Parameter P1 represents "*0000011" and parameter P2 represents "11010111". The mark "*" indicates that this bit may be either "0" or "1".

At the next step S12, data stored in the pointer DP, that is, parameter P1 is transferred to the parameter setting register (PREG) 24. At step S13, after the pointer DP is incremented by one, the program advances to step S14. At step S14, data stored in the pointer DP, that is, parameter P3 is transferred to the output pattern setting register (PREG1) 25.

At step S15 that follows, SEN←1 is set for the output control method selection flag SEN. By this, the output control method selection flag flip-flop 29*d* is set, and a load signal LD is output from the timing circuit 29*a*. Consequently, the output pattern stored in the output pattern setting register 25 is loaded into the shift register, and the shift register 27 and the octal counter 31 are made operable, so that the output control method according to the present invention is performed.

At step S16, ST←1 is set for the start flag ST. As a result, the start flag flip-flop 29*b* is set, an enable signal EN1 is output from the timing circuit 29*a*, so that the operation of the sound effect generating block 26 is started. A clock signal CLOCK to the shift register 27 is generated, and the output pattern in the shift register 27 is shifted by one bit. The parameter stored in the shift register 27 is P3, namely, "11010111", a pattern "1" is first output to the output control block 28. When the output pattern is "1", the output control block 28 is enabled to output a sound effect signal from the sound effect generating block 26, that is, a sound effect signal corresponding to "*0000011". When the output pattern is "0", the output control block is unable to output the sound effect supplied from the sound effect generating block 26.

Since the sound effect generating block 26 starts operating, a clock signal CLOCK is formed from the overflow output CARRY of the up-down counter 26*f* and applied to the shift register 27, whereby the shift register 27 is shifted by one bit and the next output pattern is supplied.

Figure 7:
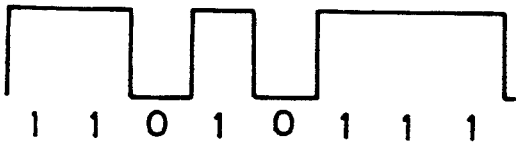
FIG. 7 shows contents of an output pattern in the embodiment of FIG. 1.

In the manner as described, the output parameter P3 "11010111" is output bit by bit as shown in FIG. 7. Thus, the sound effect signal corresponding to P1 "*0000011" is output under control by the output pattern parameter P3.

When the output pattern parameter P3 for eight bits is output, an overflow output CARRY is produced by the octal counter 31, by which the start flag flip-flop (ST F/F) 29*b* is reset, so that the start flag ST becomes 0. When the start flag flip-flop 29*b* is reset, the timing circuit 29*a* stops outputting the enable signal EN2, so that the output control block 28 stops outputting the sound effect signal.

As shown in FIG. 16, at step S17, looping continues while a check is made whether the start flag ST reaches ST=0. Therefore, when a decision that ST=0 is made, this processing routine is finished.

According to the output control method according to the present invention which has been described, data to be stored in the memory 21 are only P1 and P3, and therefore, the area of the memory 21 which is occupied by data for sound effect generation can be reduced greatly, so that more effective use can be made of the capacity of the memory 21. Furthermore, a greater number of types of data for sound effect generation can be stored in the same memory capacity.

Many widely different embodiments of the present invention may be constructed without departing from the spirit and scope of the present invention. It should be understood that the present invention is not limited to the specific embodiments described in the specification, except as defined in the appended claims.

What is claimed is:

1. A microcomputer having a sound effect output function, comprising:

register means for temporarily storing a parameter specifying a repetition unit of a sound effect to be output;

sound effect generating means for generating repeatedly a signal representing a repetition unit of a sound effect according to a parameter applied by said register means;

output pattern setting means for temporarily storing a repetition pattern of said repetition unit signal supplied from said sound effect generating means, said repetition pattern being represented by data of a plurality of bits, each bit indicating whether or not said repetition unit signal is to be output;

shift register means for shifting repetition pattern data by one bit responsive to respective one generation of said repetition unit signal and sequentially outputting bit data of said repetition pattern; and output control means for outputting said repetition unit signal, supplied from said sound effect generating means, according to output bit data supplied from said shift register means.

2. A microcomputer as claimed in claim 1, further comprising a shift register for sequentially outputting the repetition pattern, supplied from said output pattern setting means, to said output control means.

3. A microcomputer as claimed in claim 2, wherein said output control means includes a circuit for performing an AND operation between said repetition pattern supplied from said shift register and said sound effect signal supplied from said sound effect generating means.

4. A microcomputer as claimed in claim 3, wherein said circuit for performing the AND operation includes an AND gate.

5. A microcomputer as claimed in claim 1, wherein said register means includes a register for temporarily storing a parameter specifying an output time of said sound effect signal to be output.

6. A microcomputer as claimed in claim 1, wherein said register means includes a register for temporarily storing a parameter specifying an output frequency of said sound effect signal to be output.

7. A microcomputer as claimed in claim 1, wherein said register means includes a register for temporarily storing a parameter specifying an output level of said sound effect signal to be output.

8. A microcomputer as claimed in claim 1, wherein said register means includes a register for temporarily storing a parameter specifying a direction of change in the output level of said sound effect signal to be output.

9. A microcomputer as claimed in claim 1, wherein said sound effect generating means includes a circuit for generating white noise and a circuit for controlling an attribute of said generated white noise according to a parameter supplied from said register means.

10. A microcomputer as claimed in claim 9, wherein said sound effect generating means includes a circuit for controlling an output time, output frequency and output level of said generates white noise according to a parameter supplied from said register means.

11. A microcomputer having a sound effect output function, comprising:

a CPU;

memory means, connected to said CPU for storing a parameter specifying a repetition unit of a sound effect to be output and a repetition pattern of said sound effect, said repetition pattern being represented by data of a plurality of bits, each bit indicating whether or not said repetition unit of a sound effect is to be output;

register means, connected to said CPU, for temporarily storing a parameter specifying a repetition unit of a sound effect to be output, stored in said memory;

sound effect generating means, connected to said register means, for repeatedly generating a repetition unit signal of a sound effect according to a parameter supplied from said register means;

output pattern setting means, connected to said CPU and said sound effect generating means, for temporarily storing a repetition pattern, stored in said memory means, of a repetition unit signal output from said sound effect generating means;

a shift register, connected to said output pattern setting means, for shifting said repetition pattern, supplied from said output pattern setting means, by one bit in response to respective one generation of said repetition unit signal to sequentially output bit data of said repetition pattern; and output control means for outputting a repetition pattern signal output from said sound effect generating means according to output bit data supplied from said shift register.

12. A microcomputer as claimed in claim 11, wherein said output control means includes a circuit for performing an AND operation between a repetition pattern supplied from said shift register and a sound effect signal output from said sound effect generating means.

13. A microcomputer as claimed in claim 12, wherein said circuit for performing the AND operation includes an AND gate.

14. A microcomputer as claimed in claim 11, wherein said register means includes a register for temporarily storing a parameter specifying an output time of a sound effect signal to be output.

15. A microcomputer as claimed in claim 11, wherein said register means includes a register for temporarily storing a parameter specifying an output frequency of a sound effect signal to be output.

16. A microcomputer as claimed in claim 11, wherein said register means includes a register for temporarily storing a parameter specifying an output level of a sound effect signal to be output.

17. A microcomputer as claimed in claim 11, wherein said register means includes a register for temporarily storing a parameter specifying the direction of change in the output level of said sound effect signal to be output.

18. A microcomputer as claimed in claim 11, wherein said sound effect generating means includes a circuit for generating white noise and a circuit for controlling an attribute of white noise according to a parameter supplied by said register means.

19. A microcomputer as claimed in claim 18, wherein said sound effect generating means includes a circuit for controlling an output time, output frequency, and output level of white noise, which is generated, according to a parameter supplied by said register means.

* * * * *